US008312891B2

(12) United States Patent
Cavagna

(10) Patent No.: US 8,312,891 B2
(45) Date of Patent: Nov. 20, 2012

(54) AUTOMATIC SWITCHING VALVE WITH ALARM

(75) Inventor: Savio Cavagna, Brescia (IT)

(73) Assignee: Cavagna Group, Brescia (IT)

( * ) Notice: Subject to any disclaimer, the term of this patent is extended or adjusted under 35 U.S.C. 154(b) by 525 days.

(21) Appl. No.: 12/581,612

(22) Filed: Oct. 19, 2009

(65) Prior Publication Data

US 2011/0088794 A1 Apr. 21, 2011

(51) Int. Cl.
*G05D 11/00* (2006.01)
*F16K 37/00* (2006.01)

(52) U.S. Cl. ..... 137/112; 137/552; 137/559

(58) Field of Classification Search ..... 137/552, 137/557, 554, 559, 112, 113; 222/6; 116/271, 116/266

See application file for complete search history.

(56) References Cited

U.S. PATENT DOCUMENTS

| | | | | | |
|---|---|---|---|---|---|
| 1,960,466 | A | * | 5/1934 | Thrall | 137/98 |
| 2,050,113 | A | * | 8/1936 | Miner, Jr. | 340/626 |
| 2,126,355 | A | * | 8/1938 | Thomas | 116/215 |
| 2,196,251 | A | * | 4/1940 | Conrad | 137/505.22 |
| 2,578,042 | A | * | 12/1951 | Chandler | 222/6 |
| 2,754,793 | A | * | 7/1956 | Sperry | 116/4 |
| 3,129,722 | A | * | 4/1964 | Wagner | 137/557 |
| 3,207,169 | A | | 9/1965 | Miller | |
| 3,254,670 | A | * | 6/1966 | Puster | 137/557 |
| 3,288,165 | A | * | 11/1966 | Cranage | 137/505.13 |
| 3,517,693 | A | | 6/1970 | Dietz | |
| 5,868,162 | A | | 2/1999 | Dickerson, Jr. | |
| 6,223,769 | B1 | * | 5/2001 | Bragg et al. | 137/557 |
| 7,013,906 | B2 | | 3/2006 | Pearson | |
| 2001/0025349 | A1 | * | 9/2001 | Sharood et al. | 713/340 |
| 2006/0151027 | A1 | | 7/2006 | Pearson | |

FOREIGN PATENT DOCUMENTS

| | | | |
|---|---|---|---|
| EP | 1843078 | A1 | 10/2007 |
| EP | 2051000 | A1 | 4/2009 |

* cited by examiner

*Primary Examiner* — John Rivell
*Assistant Examiner* — Time Aigbe
(74) *Attorney, Agent, or Firm* — Fay Sharpe LLP

(57) ABSTRACT

A gas pressure sensor assembly for a gas regulator includes a plurality of selectable inlets, an outlet and a gauge. Each inlet receives pressurized gas from a different one of a plurality of pressurized gas storage containers. The outlet supplies gas to an appliance. The gauge senses a selected gas pressure in an inlet corresponding to the selected gas storage container and visually indicates a pressure of that gas storage container. The gas pressure sensor assembly includes a cooperating member at least partially housed within the gauge, a disc member rotatably responsive to a gas pressure and an sensing device. The sensing device is releasably connected to the gauge, is selectively actuated by movement of the disc member and is configured to provide an audible signal indicative of a generally empty status of the gas storage container.

19 Claims, 4 Drawing Sheets

AUTOMATIC SWITCHING VALVE WITH ALARM

BACKGROUND

Exemplary embodiments herein relate to pressure-sensing and indicating devices for gas systems and, more particularly, to a removable indicator/alarm device for a gas regulator for at least one pressurized gas source such as an L.P. gas tank.

Gas regulators are widely known and used to provide gas at a stepped-down pressure. One type of gas regulator is an automatic changeover two-stage LP gas regulator, such as those made by Cavagna of Italy, as well as other manufacturers. Automatic changeover gas regulators typically comprise a high-pressure changeover regulator and a low-pressure regulator. The high-pressure changeover regulator includes two inlets for receiving gas from two separate pressurized containers, reduces the gas pressure to a first predetermined level, and transmits that gas to the low-pressure regulator. The low-pressure regulator further reduces the gas pressure to a predetermined level prior to conveying the gas through an outlet to, for example, a selected appliance.

In many applications, and particularly in the recreational vehicle field, at least two gas source containers (a "supply" container and a "reserve" container) are connected to at least two corresponding inlets of the high-pressure changeover regulator. Each inlet receives gas from a different gas source container. During use of the connected appliance, when the supply container becomes depleted of gas, the regulator automatically changes over to the reserve container such that the reserve container becomes the "new supply" container for providing gas to the regulator. After the changeover, the original supply container can be disconnected from the corresponding inlet of the regulator and be replaced or refilled.

To notify the user of a changeover to the reserve container, known regulators of this type have a mechanical gauge, such as a full/empty indicator, attached to the high-pressure regulator for visually indicating a pressure of the gas received through the inlet associated with the supply container. This full/empty indicator typically includes a pressure-sensitive member, for example, a diaphragm, that is responsive to the gas pressure. The full/empty indicator also typically includes a bi-colored or similar indicator member that is mounted and displayed in a transparent capsule attached adjacent to the high-pressure changeover regulator. The indicator member abuts or is coupled to the diaphragm. As the diaphragm moves (i.e., deflects) in response to changes in pressure, the diaphragm exerts a force on the bi-colored indicator member. As a result, the diaphragm causes movement of the indicator member to display a portion of the indicator member having a color indicative of the "full/empty" status of the supply container. For example, when the supply container is generally depleted of gas after extensive use, the low gas pressure sensed by the diaphragm causes the diaphragm to deflect accordingly and thus cause corresponding movement of the bi-colored or other indicator member to display a portion of such indicator member which shows that the supply container is empty and should be disconnected.

A shortcoming of such mechanical full/empty indicators is that the gas regulator and gas containers are typically stored at a remote location, or are hidden from view. Since the supply system is usually placed out of the way, the gauge or full/empty indicator is not ordinarily visible. As such, the user has to go out of his way to inspect the gas cylinders, including the gas regulator and indicator attached thereto, to determine whether the automatic changeover has been triggered. Since the changeover is automatic and only occurs at spaced intervals and on an irregular basis, and may occur at night, the condition may go undetected for some time, leading to unexpected depletion of the reserve container.

Therefore, an indicator/alarm device is needed that conveniently notifies the user that the supply container is at or near empty, such that the user does not have to continuously and unnecessarily check the full/empty status of the gas container(s) at their remote location.

BRIEF DESCRIPTION

According to one aspect, a gas pressure sensor assembly for a gas regulator is provided. The gas regulator includes a plurality of selectable inlets, an outlet and a gauge. Each inlet is configured to receive pressurized gas from a different one of a plurality of associated pressurized gas storage containers. The outlet supplies gas to an associated appliance. The gauge senses a gas pressure in a selected inlet corresponding to the associated pressurized gas storage container from which the inlet receives pressurized gas and visually indicates a pressure of that associated gas storage container. The gas pressure sensor assembly comprises a cooperating member and a sensing device. The cooperating member is at least partially housed within the gauge and includes a disc member rotatably responsive to a gas pressure in the selected inlet. The sensing device is releasably connected to the gauge. The sensing device is selectively actuated by movement of the disc member. The sensing device is configured to provide an audible signal to a user indicative of a generally empty status of the associated gas storage container connected to the selected inlet. The sensing device can be easily removed from a gauge of one gas regulator and releasably connected to a gauge of another gas regulator.

According to another aspect, a gas regulator comprises a first regulation portion and a second regulation portion. The first regulation portion includes two selectable inlets. Each inlet is configured to receive pressurized gas from a different one of two associated pressurized gas storage containers. The second regulation portion has an outlet for supplying gas to an associated appliance. A gauge is operatively connected to the first regulation portion. The gauge has a biased member responsive to gas pressure changes at a selected one of said inlets for indicating whether the associated gas container connected to it is generally empty. A gas pressure sensor assembly includes a cooperating member and a sensing device releasably connected to the cooperating member. The cooperating member includes a rotatable disc member which is operatively connected to the biased member such that movement of the biased member causes the disc member to rotate. The sensing device includes a sound producing device and a switch for activating the sound producing device. The switch is selectively actuated by the rotational movement of the disc member. The sound producing device provides an audible signal to a user indicative of the generally empty status of the associated gas container connected to the selected one inlet.

According to yet another aspect, a two-stage gas regulator assembly comprises a high pressure changeover regulator and a low pressure regulator. The high pressure changeover regulator has first and second selectable inlets. Each of the first and second inlets is configured to receive pressurized gas from respective first and second associated pressurized gas storage containers. The low pressure regulator has an outlet for supplying gas to an associated appliance. A first indicator is operatively connected to the high pressure regulator for visually indicating a pressure status of a selected associated container. The first indicator includes a housing, a diaphragm, a pin and a rotatable disc member. The diaphragm is located within the housing and is responsive to a gas pressure in one of the first and second inlets. The pin is located within the housing and is movable along a first axis by the diaphragm. The disc member is located within the housing and is operatively connected to the pin such that an axial movement of the pin along the first axis causes a rotational movement of the disc member about the first axis. A second indicator is releasably connected to the housing of the first indicator. The second indicator includes a sound producing device which is selectively actuated by the rotational movement of the disc member. The sound producing device provides an audible signal to a user indicative of a low gas pressure within one of the first and second selectable inlets.

DETAILED DESCRIPTION

Figure 1:
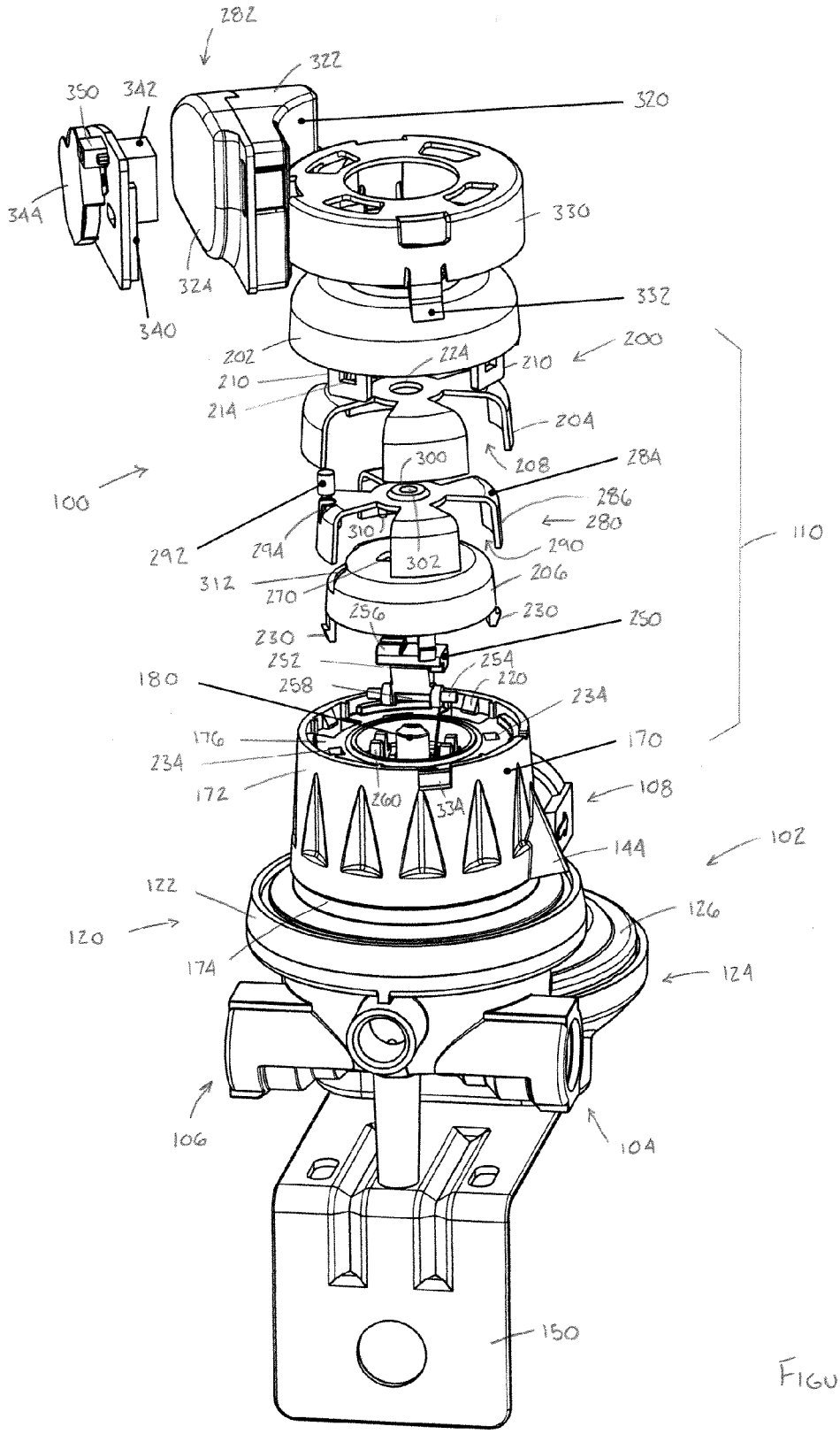
FIG. 1 is an exploded perspective view of a gas regulator including a gas pressure sensor assembly according to the present disclosure.

It should, of course, be understood that the description and drawings herein are merely illustrative and that various modifications and changes can be made in the structures disclosed without departing from the present disclosure. All references to direction and position, unless otherwise indicated, refer to the orientation of the gas regulator illustrated in the drawings and should not be construed as limiting the claims appended hereto.

Figure 3:
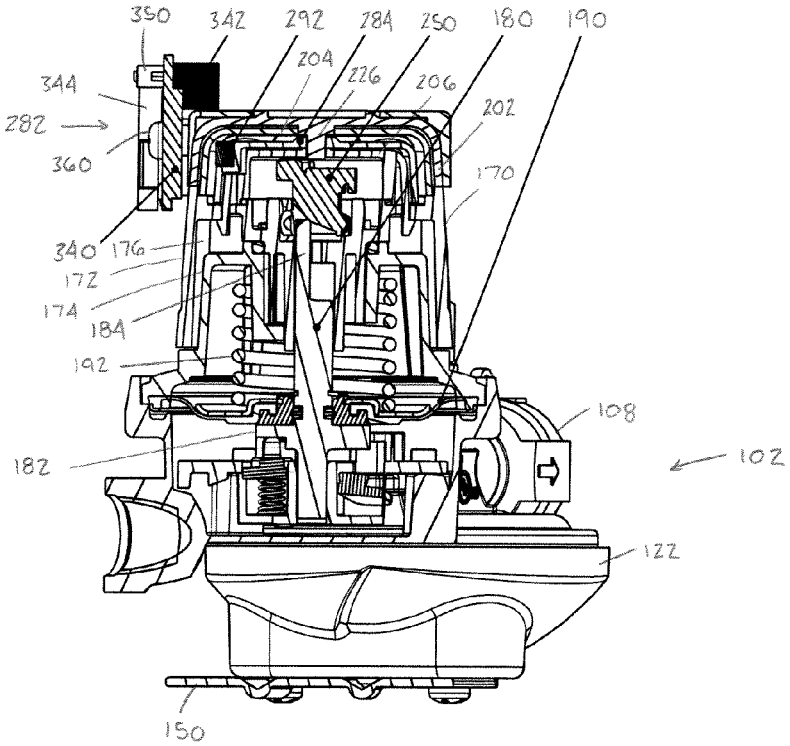
FIG. 3 is a side elevational view in cross-section of the gas regulator of FIG. 2.
Figure 4:
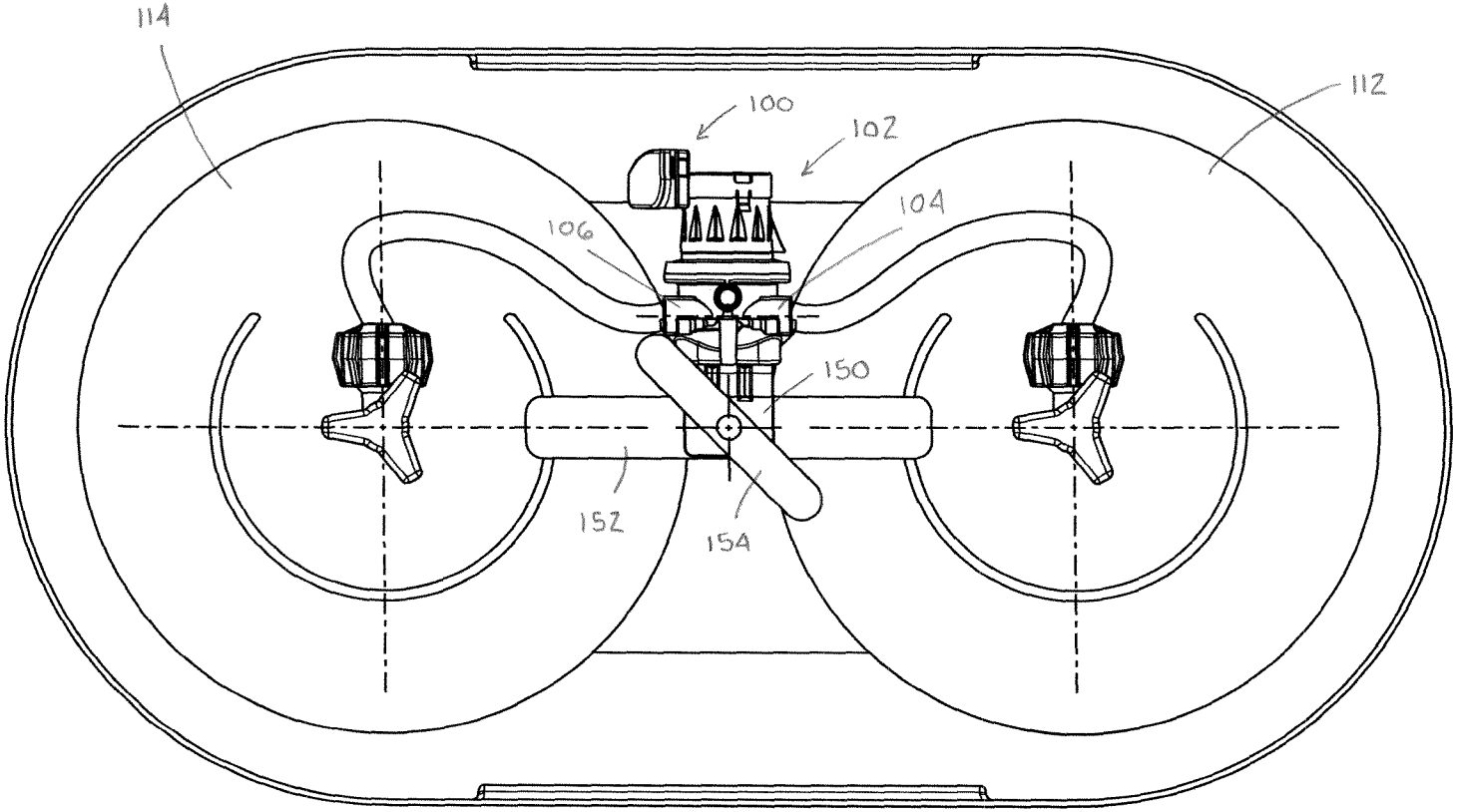
FIG. 4 is a top perspective view of the gas regulator of FIG. 1 operatively mounted to a pair of pressurized gas storage containers.
Figure 5:
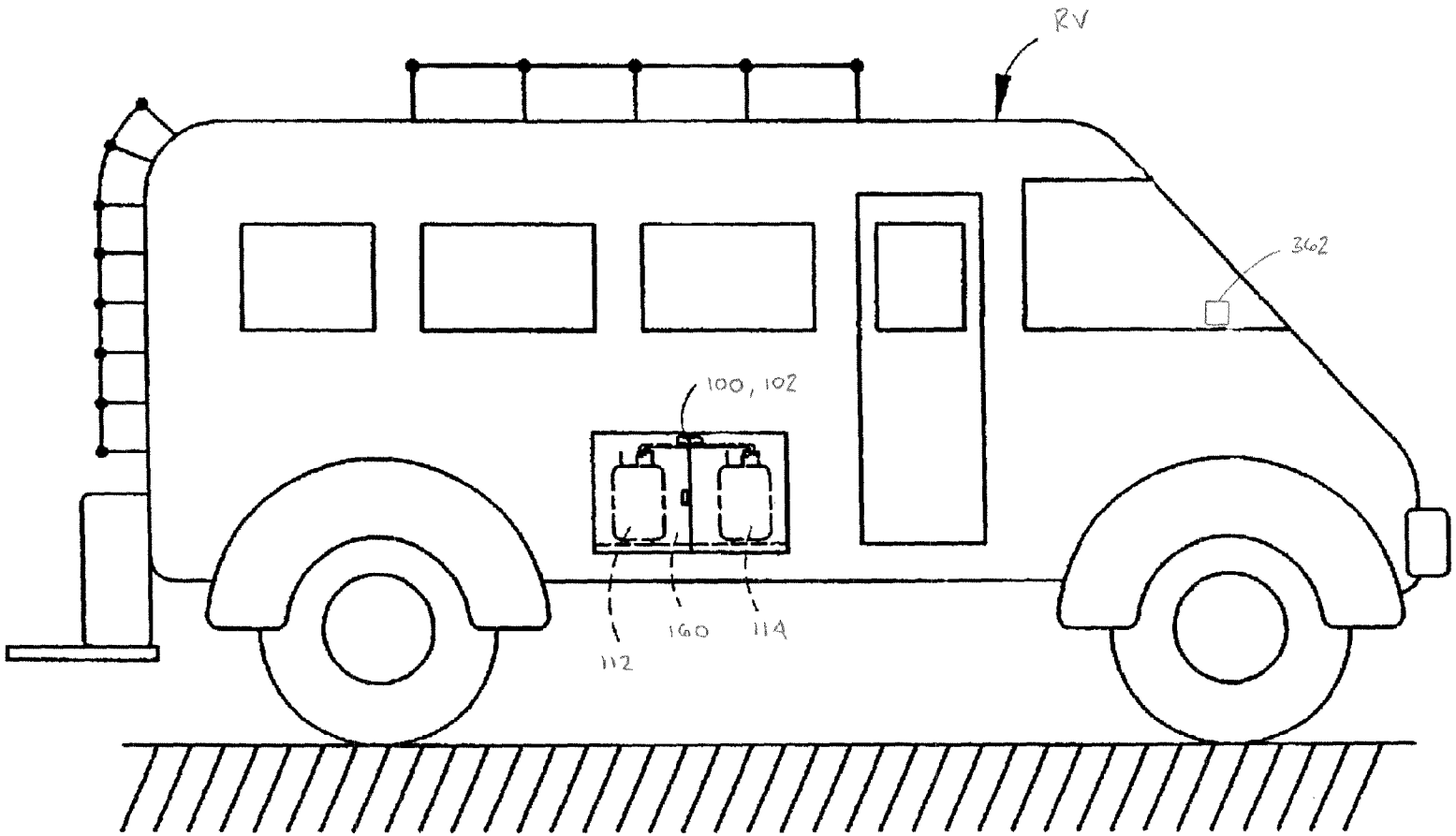
FIG. 5 is a schematic side elevational view of a recreational vehicle including the gas regulator and pressurized gas storage containers of FIG. 4.

Referring now to drawings, wherein like numerals refer to like parts throughout the several views, FIGS. 1-4 illustrate a gas pressure sensor assembly 100 for a gas regulator 102, such as a two-stage LP gas regulator. The gas regulator 102 includes a plurality of selectable inlets (two inlets 104, 106 are shown), an outlet 108 and a gauge 110. Each inlet is configured to receive pressurized gas from a different one of a plurality of pressurized gas storage containers 112, 114 (FIG. 4). One of the gas storage containers is typically referred to as a "supply" container and the other gas storage container is typically referred to as a "reserve" container. The outlet 108 supplies gas to an appliance (not shown), for example, a cooking appliance for a recreational vehicle RV (FIG. 5). The gauge 110 senses a gas pressure in one of the selected inlets 104, 106 corresponding to the pressurized gas storage container 112, 114 from which the inlet receives pressurized gas. The gauge 110 can be a full/empty indicator configured to visually indicate a gas pressure of that gas storage container and can show that the gas storage container is generally empty.

More particularly, the exemplary gas regulator 102 includes a first regulation portion 120 having a high-pressure changeover regulator 122 and a second regulation portion 124 having a low-pressure regulator 126. The first regulation portion includes the inlets 104, 106, each of which receives gas from one of the separate gas storage containers 112, 114. The first regulation portion 120 also includes a selector device 144 or hand wheel for selecting which inlet 104, 106 supplies the gas to high-pressure regulator 122. The low-pressure regulator 126 includes the outlet 108 for transmitting the gas to the appliance (not shown). A first bracket 150 is connected to the gas regulator 102. As shown in FIG. 4, the first bracket is mounted to a second bracket 152 via a connector 154 which spans between the first and second gas storage containers 112, 114. It should be appreciated that alternative manners for mounting the gas regulator 102 to the pressurized gas storage containers are also contemplated.

In operation, the selector device 144 selects one of the inlets 104, 106 and the corresponding gas storage container 112, 114 is to be used first (e.g., the "supply" container), thus making the gas storage container connected to the other inlet the "reserve" container. Thereafter, a main control valve on each of the gas storage containers 114, 116 is opened such that gas is supplied to both inlets 104, 106. Although both inlets 104, 106 receive gas from their respective gas storage containers 112, 114, the selector device 144 operates a known internal valve mechanism (not shown) which selectively couples gas received through only one of the inlets to the gas regulator 102. After opening the main control valves on the gas storage containers, the gauge 110, which is attached to the high-pressure regulator 122, senses the pressure of the gas supplied by the selected storage container and, based on the sensed pressure, indicates the pressure or full/empty status of that container. As described in more detail below, the gauge 110 can provide a visual signal to a user that corresponds to the gas pressure in the supply container.

The high-pressure changeover regulator 122 processes gas input from one of inlets 104, 106 connected to the supply container by reducing the pressure of the received gas to a predetermined lower level. The lower-pressure gas is then transmitted to low-pressure regulator 126 for further reducing the gas pressure to a level that is suitable for use in, for example, an appliance. The low-pressure regulator then transmits the gas to the appliance. During use of the connected appliance, when the supply container becomes depleted of gas, the gas regulator automatically changes over to the reserve container such that the reserve container becomes the "new supply" container for providing gas to the gas regulator. The gauge 110 continues to indicate the gas pressure of the depleted storage container until the selector device 144 is moved towards the "new supply" container. After the changeover, the original supply container can be disconnected from the corresponding inlet of the regulator and be either replaced or refilled.

To notify the user of a changeover to the reserve container, the gauge 110, visually indicates a pressure of the gas received through the inlet associated with the supply container. As indicated previously, a shortcoming of the visual gauge 110 is that the gas regulator 102 and gas containers 112, 114 are typically stored at a remote location, for example, in a storage area 160 located outside the cab or occupied interior space of the recreational vehicle (FIG. 5) or otherwise under a cover. Thus, the gauge 110 is not ordinarily viewable.

With reference to FIGS. 1 and 3, the gauge 110 comprises a housing assembly 170 including a first housing part 172, a second housing part 174 and a third housing part 176 located between the first and second housing parts. The first housing part 172 includes the selector device 144 and at least partially surrounds the second and third housing parts 174, 176. The housing assembly 170 houses a biased member or moveable pin 180 which is responsive to gas pressure changes at a selected one of the inlets 104, 106. The pin 180 includes a first end section 182 and a second end section 184. The first end section is operatively connected to a resilient pressure sensitive element or diaphragm 190 which at least partially covers an open end of the second housing part 174. The diaphragm 190 is movable (i.e., resiliently flexed) in response to changes in pressure of the gas impinging thereon. A spring 192 provided between the diaphragm and a closed upper end of the second housing part at least partially surrounds the pin 180.

The gauge 110 further comprises a lid assembly 200 that connects to the housing assembly 170. The lid assembly includes a first lid part 202, a second lid part 204 and a third lid part 206. Each lid part is generally cup shaped. The second lid part 204 has spaced apart cutouts or openings 208. The first lid part 202 is secured to the first housing part 172, the third lid part 206 is secured to the third housing part 176 and the second lid part 204 is positioned or trapped between the first and third lid parts. Particularly, as shown in FIG. 1, the first lid 202 part includes spaced apart downwardly extending tabs 210. Each tab 210 includes an opening 214 dimensioned to receive a shoulder 220 located on an inner surface of the first housing part 172. The second lid part 204 includes a centrally located opening 224. As shown in FIG. 3, the opening 224 receives an upper portion of a pin 226 extending downwardly from an underside of the first lid part. The third lid part 206 includes spaced apart engagement members or fingers 230 which are received in corresponding openings 234 located on a top portion of the third housing part.

With continued reference to FIGS. 1 and 3, a lever 250 is rotatably connected within the gauge 110. The lever includes a body 252, a pair of pegs 254 projecting outwardly from a lower portion of the body and a grooved member 256 located on an upper portion of the body. In the depicted embodiment, the body is generally T-shaped; although, this is not required. As will be discussed in greater detail below, the lower portion of the body 252 includes a sloped surface 258 which is engaged by movement of the pin 180. Each peg 254 is rotatably received in a clip 260 located in the housing assembly 170. The pegs together define a first axis. The grooved member 256 is located beneath an opening 270 in the third lid part 206.

The gas pressure sensor assembly 100 comprises a cooperating member 280 at least partially housed within the gauge 110 and a sensing device 282 releasably connected to the gauge. In one embodiment, the cooperating member 280 includes a disc member 284 rotatably responsive to a gas pressure in the selected inlet 104, 106. Similar to the second lid part 204, the disc member 284 is generally cup shaped and includes arms 286 spaced apart by openings or cutouts 290. As shown in FIGS. 1 and 3, a magnet 292 is mounted within an opening or socket 294 located on the disc member 284. To rotatably mount the disc member within the housing assembly 170, the disc member is located between the second lid part 204 and the third lid part 206. The disc member includes a centrally located raised portion or collar 300 having an opening 302. The opening 302 has a diameter smaller than a diameter of opening 224. A lower portion of the pin 226 of the first lid part 202 protrudes into the opening 300. In this way, the disc member 284 is rotatably mounted in relation to the first lid part 202. The disc member further includes a downwardly extending pin or flange 310 which projects through the opening 270 and is slidingly received in the grooved member 256. To accommodate the rotational movement of the magnet 292, the third lid part 206 includes an arcuate cutout 312 dimensioned to at least partially receive the magnet.

In operation, the pin 180, as connected to the diaphragm 190, is responsive to gas pressure changes at a selected one of the inlets 104, 106. The disc member 284 is operatively connected to the pin such that axial movement of the pin along a second axis causes the disc member to rotate about the second axis. Particularly, the sloped surface 258 of the lever 250 is engaged by the axial movement of the pin 180 along the second axis, which is generally perpendicular to the first axis. As the pin 180 pushes on the sloped surface 258, it rotates the lever about the first axis. Rotation of the lever slidingly moves the flange 310 within the grooved member 256 and along an arcuate wall of the opening 270. This, in turn, causes the disc member to rotate about the second axis. Thus, the lever transforms a longitudinal movement of the pin into the rotational movement of the disc member.

To visually indicate the pressure status of the supply container, the first lid part 202 is at least partially transparent, the second lid part 204 can be of a first color (e.g., white), the third lid part 206 can be of a second color (e.g., red), and the disc member 284 can be of a third color (e.g., green). In a generally full status, the cutouts 290 of the disc member 284 are generally aligned with the cutouts 208 of the second lid part 204. Thus, the second color of the third lid part 206 is visible through the first lid part 202. As pressure decreases, the disc member 284 rotates within the housing assembly 170. As the disc member rotates, the cutouts move out of alignment such that the arms 286 of the disc member at least partially cover the third lid part 206. The third color of the disc member is now visible through the first lid part. Therefore, when the supply container is generally depleted of gas after extensive use, the low gas pressure sensed by the diaphragm 190 causes the diaphragm to deflect accordingly and thus causes corresponding movement of the pin 180, the lever 250 and the disc member 284 to display the arms 286 of the disc member and indicate that the supply container should be disconnected and replaced with a standby container.

Figure 2:
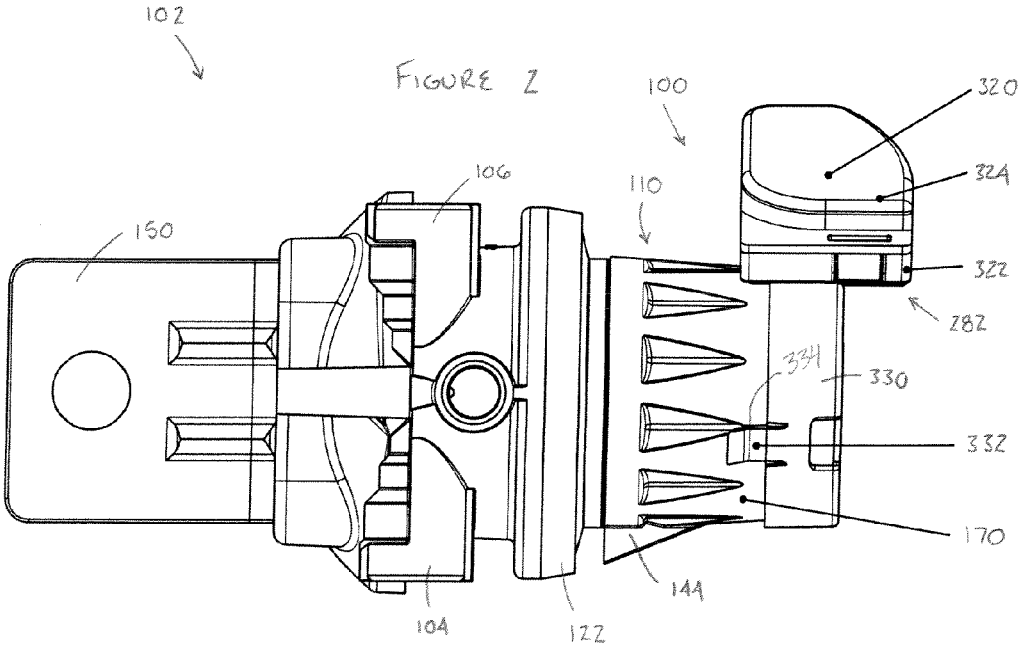
FIG. 2 is a top perspective view of the gas regulator of FIG. 1.

With reference to FIGS. 1-3, the sensing device 282 includes a housing 320 having a first housing part 322 and a second housing part 324. The second housing part is hingedly connected to the first housing part such that the second housing part serves as a lid for the first housing part. A bracket 330 is connected to the first housing part 322. The bracket includes an engagement member 332 for releasably engaging the gauge. In the depicted embodiment, the engagement member comprises a finger for releasably engaging a slot 334 located on first housing part 172 of the gauge 110; although, alternative manners for releasably connecting the sensing device to the gauge are contemplated. This allows the sensing device 282 to be easily removed from a gauge of one gas regulator and releasably connected to a gauge of another gas regulator.

The sensing device 282 is selectively actuated by movement of the disc member 284 and is configured to provide an audible signal to a user indicative of a generally empty status of the gas storage container 112, 114 connected to the selected inlet 104, 106. Particularly, housed within the housing 320 of the sensing device 282 is a switch 340 selectively actuated by the disc member 284, a sound producing or acoustic alarm device 342 operatively connected to the switch, and a battery 344 for providing power to the alarm device. The sensing device can further include a testing device 350 for testing a power status of the battery. In the exemplary embodiment, the switch 340 is a magnetic switch such as a known flexible blade circuit breaker or a known Hall-effect type circuit breaker. Rotation of the magnet 292 connected to the disc member 284 selectively actuates the switch. In use, as the gas pressure of the supply container decreases, the disc member 284 begins to rotate. At a predetermined rotational position, the magnet actuates the switch. This, in turn, activates the acoustic alarm device 342, which can be a buzzer or the like. When this occurs, the user will turn the selector device or hand wheel 144 towards the "new supply" container to turn off the alarm device. The gauge 110 will now read the gas pressure in the "new supply" container. The switch 340 of the sensing device 282 overrides the alarm device 342 so that actuation if the alarm device is controlled by the switch. It would also be possible to install a circuit that operates the acoustic alarm device 342 only during a given period, and at spaced intervals, such as, for example, one minute every hour. In accordance with another embodiment, the sensing device 282 can include a transmitter 360 (FIG. 3) housed within the housing 320 and a receiver 362 (FIG. 5) positioned at a location that is remote from the gas regulator 102. The transmitter sends an alarm signal to the receiver, which emits an alarm warning. For example, the alarm device 342 can include a radio emitter and a radio receiver can be located in the interior of the recreational vehicle, such as on the dashboard.

The acoustic alarm device 342 disclosed herein provides an audible signal to a user indicative of a low gas pressure condition within one of the first and second inlets 104, 106. Therefore, the gas pressure sensor assembly 100 conveniently notifies the user that the supply container is at or near empty, such that the user does not have to continuously and unnecessarily check the full/empty status of the gas container(s) at their remote location.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art. It is intended that all of these, or equivalents thereof, are encompassed by the following claims.

The invention claimed is:

1. A gas pressure sensor assembly for a gas regulator, the gas regulator including a plurality of selectable inlets, each inlet configured to receive pressurized gas from a different one of a plurality of associated pressurized gas storage containers, an outlet for supplying gas to an associated appliance, and a gauge for sensing a gas pressure in a selected inlet corresponding to the associated pressurized gas storage container from which the inlet receives pressurized gas and visually indicating a pressure of that associated gas storage container, the gas pressure sensor assembly comprising:

a cooperating member at least partially housed within the gauge and including a disc member rotatably responsive to a gas pressure in the selected inlet;

a sensing device releasably connected to the gauge, the sensing device being selectively actuated by movement of the disc member, the sensing device configured to provide an audible signal to a user indicative of a generally empty status of the associated gas storage container connected to the selected inlet, wherein the sensing device can be easily removed from a gauge of one gas regulator and releasably connected to a gauge of another gas regulator; and wherein the cooperating member further includes a lever rotatably connected within the gauge, wherein rotational movement of the lever about a first axis causes rotational movement of the disc member about a second axis, wherein the first axis is generally perpendicular to the second axis.

2. The gas pressure sensor assembly of claim 1, wherein the sensing device includes an engagement member for releasably engaging the gauge.

3. The gas pressure sensor assembly of claim 2, wherein the sensing device includes a housing and the engagement member comprises a finger which releasably engages a slot located on the gauge.

4. The gas pressure sensor assembly of claim 1, wherein the sensing device includes a switch and wherein a rotation of the disc member selectively actuates the switch.

5. The gas pressure sensor assembly of claim 4, wherein the switch is a magnetic switch and the disc member includes a magnet for selectively actuating the switch.

6. The gas pressure sensor assembly of claim 4, wherein the sensing device includes a sound producing device which is operatively connected to the switch.

7. The gas pressure sensor assembly of claim 6, wherein the sensing device includes a battery for providing power to the sound producing device.

8. The gas pressure sensor assembly of claim 7, wherein the sensing device includes a testing device for testing a power status of the battery.

9. The gas pressure sensor assembly of claim 1, wherein the gauge includes a moveable first pin for engaging the lever, the lever transforming a longitudinal movement of the pin along the second axis into the rotational movement of the disc member.

10. The gas pressure sensor assembly of claim 9, wherein the lever includes a sloped surface and a groove and the disc member includes a second pin slidingly received in the groove, wherein as the first pin pushes on the sloped surface, it rotates the lever about the first axis, rotation of the lever slidingly moving the second pin within the groove which, in turn, causes the disc member to rotate about the second axis.

11. A gas regulator comprising:

a first regulation portion and a second regulation portion, the first regulation portion including two selectable inlets, each inlet configured to receive pressurized gas from a different one of two associated pressurized gas storage containers, the second regulation portion having an outlet for supplying gas to an associated appliance;

a gauge operatively connected to the first regulation portion, the gauge having a biased member responsive to gas pressure changes at a selected one of said inlets for indicating whether the associated gas container connected to it is generally empty;

a gas pressure sensor assembly including:

a cooperating member including a rotatable disc member, the disc member being operatively connected to the biased member such that movement of the biased member causes the disc member to rotate; and a sensing device releasably connected to the cooperating member, the sensing device including a sound producing device and a switch for activating the sound producing device, the switch being selectively actuated by the rotational movement of the disc member, the sound producing device providing an audible signal to a user indicative of the generally empty status of the associated gas container connected to the selected one inlet; and wherein the cooperating member further includes a rotatable lever, the lever being engaged by the biased member to rotate the lever about a first axis, wherein rotation of the lever causes the disc member to rotate about a second axis, the lever transforming a longitudinal movement of the biased member to the rotational movement of the disc member.

12. The gas pressure sensor assembly of claim 11, wherein the sensing device includes a housing having at least one finger for releasably engaging the gauge.

13. The gas pressure sensor assembly of claim 11, wherein the switch is a magnetic switch and the disc member includes a magnet for selectively actuating the switch.

14. The gas pressure sensor assembly of claim 13, wherein the disc member further includes a color for visually indicating the generally empty status of the associated gas container.

15. The gas pressure sensor assembly of claim 11, wherein the sensing device further includes a battery for providing power to the sound producing device and a manual circuit breaker for testing a voltage level of the battery.

16. A two-stage gas regulator assembly comprising:

a high pressure changeover regulator having first and second selectable inlets, each of the first and second inlets configured to receive pressurized gas from respective first and second associated pressurized gas storage containers;

a low pressure regulator having an outlet for supplying gas to an associated appliance;

a first indicator operatively connected to the high pressure regulator for visually indicating a pressure status of a selected associated container, the first indicator including:

a housing;

a diaphragm located within the housing and responsive to a gas pressure in one of the first and second inlets, a pin located within the housing and movable along a first axis by the diaphragm, and a rotatable disc member located within the housing and operatively connected to the pin such that an axial movement of the pin along the first axis causes a rotational movement of the disc member about the first axis; and a second indicator releasably connected to the housing of the first indicator, the second indicator including an acoustic alarm device which is selectively actuated by the rotational movement of the disc member, the acoustic alarm device providing an audible signal to a user indicative of a low gas pressure within one of the first and second selectable inlets.

17. The gas regulator assembly of claim 16, wherein the second indicator includes:

a housing configured to releasably engage the housing of the first indicator, a magnetic switch housed within the housing for activating the acoustic alarm device, and a battery housed within the housing for providing power to the acoustic alarm device.

18. The gas regulator assembly of claim 17, further comprising a magnet mounted to the disc member, the magnet selectively actuating the magnetic switch.

19. The gas regulator assembly of claim 17, wherein the second indicator includes a transmitter housed within the housing and a receiver positioned at a location that is remote from the gas regulator assembly, the transmitter sending an alarm signal to the receiver which emits an alarm warning.

* * * * *